US005136330A

United States Patent [19]

Sato

[11] Patent Number: 5,136,330

[45] Date of Patent: Aug. 4, 1992

[54] IRREGULAR ROTATION PREVENTION STRUCTURE FOR PHOTOCONDUCTIVE DRUM

[75] Inventor: Tsutomu Sato, Tokyo, Japan

[73] Assignee: Asahi Kogaku Kogyo Kabushiki Kaisha, Tokyo, Japan

[21] Appl. No.: 775,893

[22] Filed: Oct. 15, 1991

[30] Foreign Application Priority Data

Oct. 15, 1990 [JP] Japan ..... 2-107806[U]

[51] Int. Cl.[5] ..... G03G 21/00

[52] U.S. Cl. ..... 355/200; 355/210

[58] Field of Search ..... 355/210, 211, 200; 29/110

[56] References Cited

U.S. PATENT DOCUMENTS 3,490,841 1/1970 Cely et al. .

4,671,645 6/1987 Saito et al. .

4,739,702 4/1988 Kobler ..... 29/110 X 5,053,817 10/1991 Ogiri et al. ..... 355/211

*Primary Examiner*—R. L. Moses

*Attorney, Agent, or Firm*—Sandler, Greenblum & Bernstein

[57] ABSTRACT

An irregular rotation prevention structure is provided for a photoconductive drum employed in an electrophotographic imaging apparatus. The prevention structure includes regulation members for regulating the movement of the photoconductive drum in a direction perpendicular to the rotary axis of the photoconductive drum. The regulation members are located at a position substantially confronting a resultant force that is produced by the interaction between the photoconductive drum and the peripheral elements which are mechanically connected to the photoconductive drum.

8 Claims, 3 Drawing Sheets

IRREGULAR ROTATION PREVENTION STRUCTURE FOR PHOTOCONDUCTIVE DRUM

BACKGROUND OF THE INVENTION

The present invention relates to a structure to be adapted in an imaging device for preventing an irregular rotation of a photoconductive drum.

Conventionally, an imaging device is known, such as copy machine, a laser beam printer and the like, making use of a so-called electrophotographic image forming method. In the electrophotographic imaging device, a uniformly charged surface of a photoconductive drum is exposed to light to form a latent image, charged toner is adhered to the latent image to form a toner image, and the toner image is transferred onto a recording sheet and fixed thereon.

In a laser beam printer, for example, a toner cleaner, a discharging unit, a charging unit, a scanning optical system (i.e., scanning/exposing mechanism) for introducing a laser beam onto a photoconductive drum, a developing unit, and a transfer unit disposed around a photoconductive drum, which is rotated at a predetermined peripheral speed, along the rotary direction thereof. An image is transferred at the transfer unit onto a recording sheet, which is fed synchronously with the circumferential speed of the photoconductive drum. The image transferred to the recording sheet at the transfer unit is fixed thereon by a fixing unit and then the recording paper is discharged out of the printer.

Although the photoconductive drum is rotatably supported by a unit frame with some play, a predetermined tolerance for engagement is necessary required between a rotary shaft of the photoconductive drum and the unit frame to enable the photoconductive drum to rotate. Thus a problem arises in that the rotary axis of the photoconductive drum is moved by the amount of the tolerance, and an image being formed is blurred by the movement due to the aforesaid resultant force. Note that the image is disturbed while the photoconductive drum is being moved by the resultant force, and is not disturbed when the photoconductive drum has been moved and then rotates at a given position.

SUMMARY OF THE INVENTION

It is therefore an object of the present invention to provide a structure for preventing an irregular rotation of a photoconductive drum by which the movement of the rotary axis of the photoconductive drum can be prevented.

For the above object, according to the present invention, there is provided an irregular rotation prevention structure for a photoconductive drum employed in an electrophotographic imaging apparatus, comprising regulation members for regulating the movement of the photoconductive drum, which is located at a position substantially confronting a resultant force produced when the photoconductive drum starts rotation, and acting in a direction perpendicular to the rotating axis of the photoconductive drum.

Optionally, the regulation member comprises a pair of press members urged to the circumferential surfaces of the axial side ends of the photoconductive drum which do not contribute to the formation of an image.

Further, the imaging apparatus further employs a driving roller unit for rotating the photoconductive drum, a toner supply roller for supplying toner onto the circumferential surface of the photoconductive drum, and a pair of gap adjusting rollers arranged coaxially with the toner supply roller. The circumferential surface of each of the pair of gap adjusting rollers is contacted with the circumferential surface of the photoconductive drum to keep a predetermined gap between the circumferential surface of the toner supply roller and that of the photoconductive roller.

The resultant force is produced by a combination of forces generated at the positions where the driving roller unit and the pair of gap adjusting rollers interact, respectively, with the photoconductive drum.

Further, the regulation members may optionally comprise a pair of elastic members arranged to contact the circumferential surface of the longitudinal end portions of the photoconductive drum, respectively.

Furthermore, the circumferential angles between any adjacent pairs of the three portions where the regulating members, the driving mechanism, and the pair of gap adjusting rollers interact, with the photoconductive drum, respectively, are substantially the same.

Still further, the pair of gap adjusting rollers contact the photoconductive drum at the portions which do not contribute to the image formation;

wherein the regulation members comprises a pair of elastic members made of felt; and wherein the elastic members contact the photoconductive drum at the same axial portions as the gap adjusting rollers contact, whereby the portions where the gap adjusting rollers contact is cleaned and the amount of the gap is accurately kept at the predetermined amount.

Furthermore, the drive roller unit and the pair of gap adjusting rollers are arranged in such a fashion that the portions at which the drive roller unit and the pair of gap adjusting rollers interact with the photoconductive drum are located oppositely with respect to a vertical plane including the rotary axis of the photoconductive drum, and below a horizontal plane including the rotary axis of the photoconductive drum.

DESCRIPTION OF THE ACCOMPANYING DRAWINGS

DESCRIPTION OF THE EMBODIMENT

Figure 1:
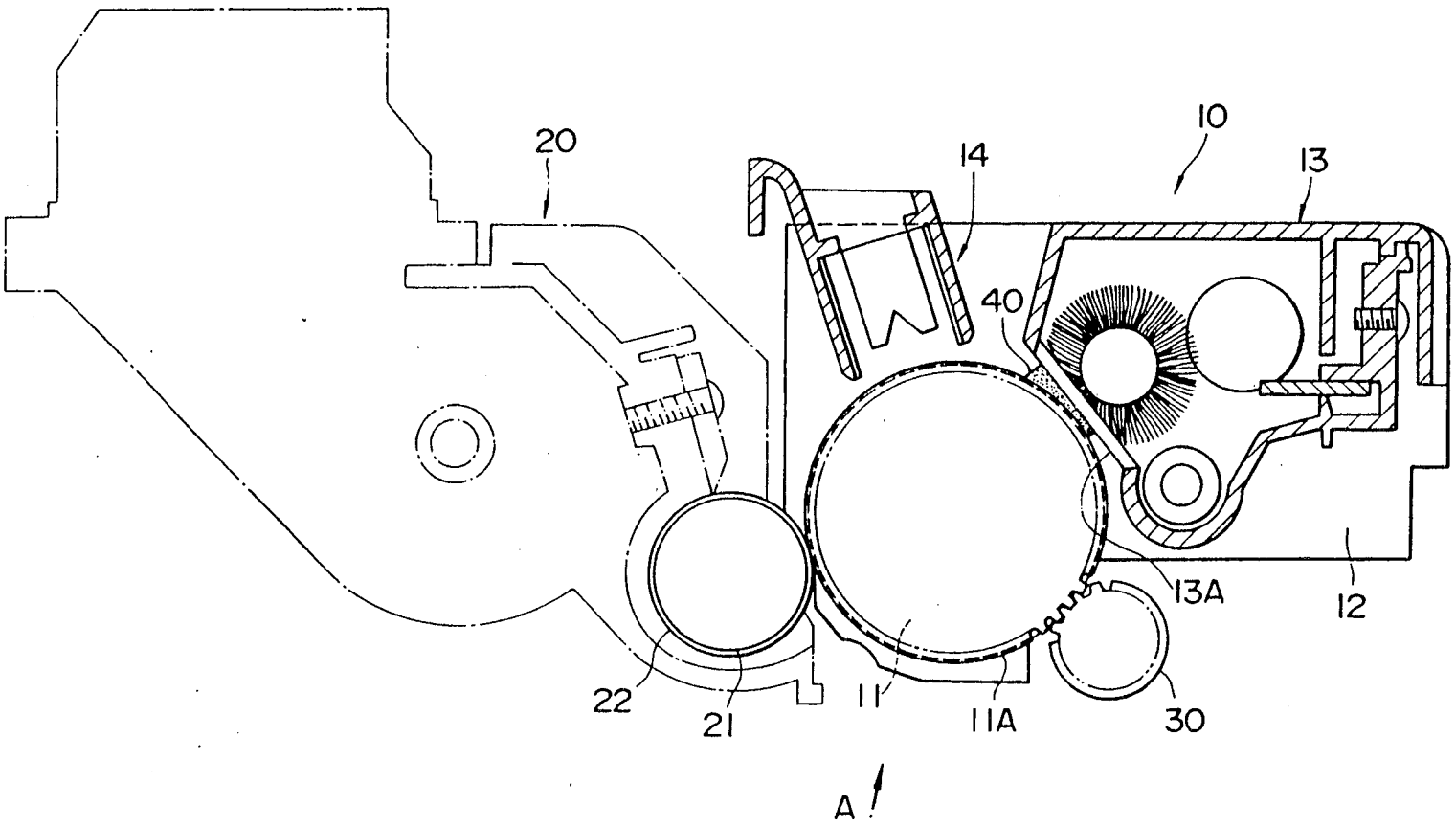
FIG. 1 is a cross sectional view of a photoconductive drum unit of a laser beam printer an irregular rotation prevention structure according to the present invention.

FIG. 1 is a cross sectional view of a photoconductive drum unit of a laser beam printer with an irregular rotation prevention structure embodying the present invention.

A photoconductive drum 11 is a consumable component having a limited life because it is worn as used and the performance of the electrostatic photoconductive material is deteriorated. Therefore, the photoconductive drum 11 is preferably easily exchanged, and accordingly it is arranged as a unit including other peripheral components.

The photoconductive drum unit 10 includes the photoconductive drum 11 having a photoconductive material on the circumferential surface thereof. The photoconductive drum 11 is rotatably supported by a unit frame 12 at the both side ends thereof. A cleaning unit 13 is located substantially on the upper right side of the photoconductive drum 11 in FIG. 1, and a charging unit 14 located on the upper left side thereof.

The photoconductive drum unit 10 is mounted on a main body of a laser beam printer (not shown) through the unit frame 12 and has a predetermined positional relationship with a developing unit 20 which also is mounted on the laser beam printer at a predetermined position.

A gear 11A is fixedly provided on the photoconductive drum 11 at one side end thereof, and when the photoconductive drum unit 10 is mounted at a predetermined position of the main body of the laser beam printer, the gear 11A is meshed with a drive gear 30 which is driven by a not shown motor, and thus the photoconductive drum 11 is rotated as the gear 11A is driven to rotate by the drive gear 30.

Incidentally, the developing unit 20, which is indicated by a one-dotted line in FIG. 1, supplies toner charged by a developing roller 21 to the photoconductive drum 11. The developing roller 21 comprises a cylindrical sleeve having a magnetic roller rotatably fitted therein, and a gap (i.e., developing gap) between the outer circumference of the developing roller and the outer circumference of the photoconductive drum set to a predetermined amount with a high accuracy in order to carry out an excellent developing operation.

In order to obtain the predetermined amount of gap, there is provided a pair of gap adjusting rollers 22, 22 respectively having a radius larger than that of the developing roller 21 by the height of the developing gap. The gap adjusting rollers 22, 22 are provided at both side end portions of the developing roller 21 which do not contribute to the image formation. The gap adjusting rollers 22, 22 contact the outer circumference of the photoconductive roller 11 so that a predetermined gap is defined between the outer circumference of the developing roller 21 and the outer circumference of the photoconductive drum 11.

More specifically, the opposite end portions of the photoconductive drum 11 disposed at a predetermined position are abutted against the gap adjusting rollers 22, 22 provided in the developing unit 20. The portions of the photoconductive drum 11 being contacted with the gap adjusting rollers 22, 22 do not contribute to the image formation. The gear 11A fixed at one side end of the photoconductive drum 11 is meshed with the drive gear 30. The position where the gap adjusting rollers 22 contact the photoconductive drum 11 and the position where the drive gear 30 is meshed with the photoconductive drum 11 are substantially symmetrically arranged with respect to the vertical plane including the rotary axis of the photoconductive drum 11.

In order to make the photoconductive drum unit 10 easy to dismount, the pair of gap adjusting rollers 22, 22 are disposed at the position opposite to the drive gear 30 with respect to the vertical plane passing through the rotary axis of the photoconductive drum 11, and the pair of gap adjusting rollers 22, 22 and the drive gear 30 are arranged below the horizontal plane passing through the rotary axis of the photoconductive drum 11. Constructed as above, the photoconductive drum 11 is supported by the drive gear 30 and the gap adjusting rollers 22, 22.

When, however, the drive gear 30 and the gap adjusting rollers 22, 22 are arranged as above, since the gap adjusting rollers 22, 22 are in contact with and driven to rotate by the photoconductive drum 11, which is driven to rotate as the gear 11A is driven by the drive gear 30, forces are applied to the photoconductive drum 11 at the respective contact portions on the photoconductive drum 11. Therefore a resultant force obtained from the forces applied at both contact portions is applied to the photoconductive drum 11 and thus the photoconductive drum 11 is urged to move in the direction of the resultant force. If the photoconductive drum 11 is installed in the printer with a certain play, it is moved with the resultant force by the amount of the play and irregularly rotated at the beginning of the rotation thereof. A defective image is formed if the rotary axis of the photoconductive drum 11 is moved while the image forming operation is executed (in particular, during a scanning operation).

In order to prevent the above-mentioned irregular rotation of the photoconductive drum 11, in the present invention, contact members 40, 40 as movement regulation means are provided on the unit frame. The contact members 40, 40 are made of felt. The position where the contact members 40, 40 contact the circumferential surface of the photoconductive drum 11, the position where the photoconductive drum 11 contacts the gap adjusting rollers 22, and the position where the drive gear 30 is meshed with the gear 11A of the photoconductive drum 11 divide the circumference of the photoconductive drum 11 into substantially three equal portions.

Figure 2:
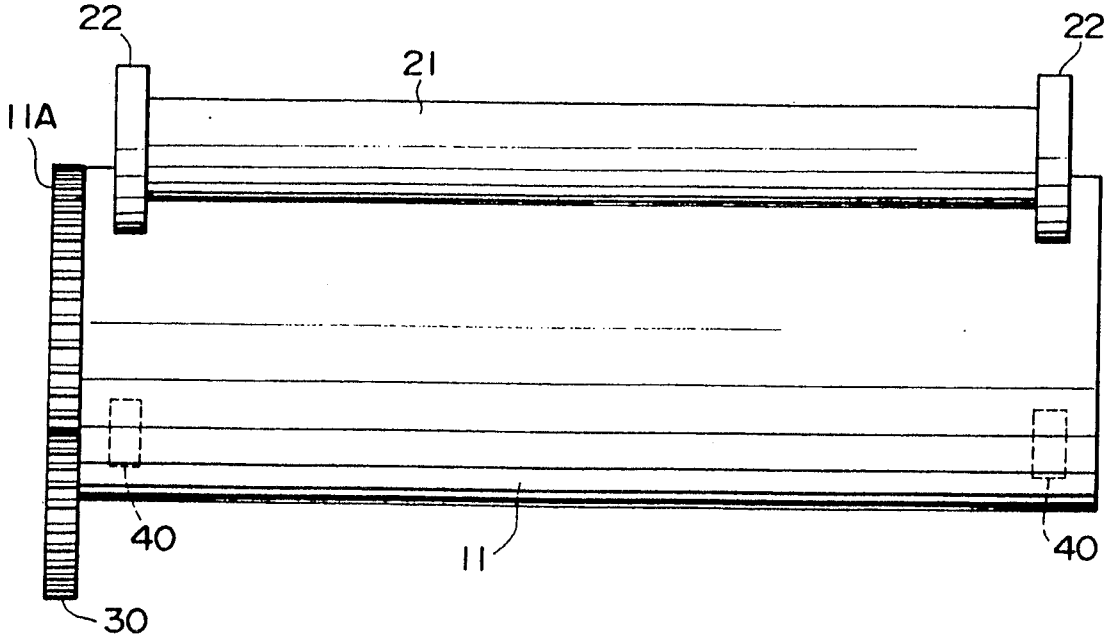
FIG. 2 is a partial bottom view of the photoconductive drum unit viewed from arrow A of FIG. 1.

The contact members 40, 40 are adhered onto a cover 13A of a cleaning unit 13 which is projected from the inner surface of the unit frame 12 at the portion where the contact members 40, 40 confront the photoconductive drum 11. With this construction, the contact member 40, 40 are abutted with a predetermined pressing force against the outer circumference at the both side end portions of the photoconductive drum 11, which are substantially the same portions at which the gap adjusting rollers 22, 22 contact, and are the portions which do not contribute to the image formation (see FIG. 2).

Figure 3:
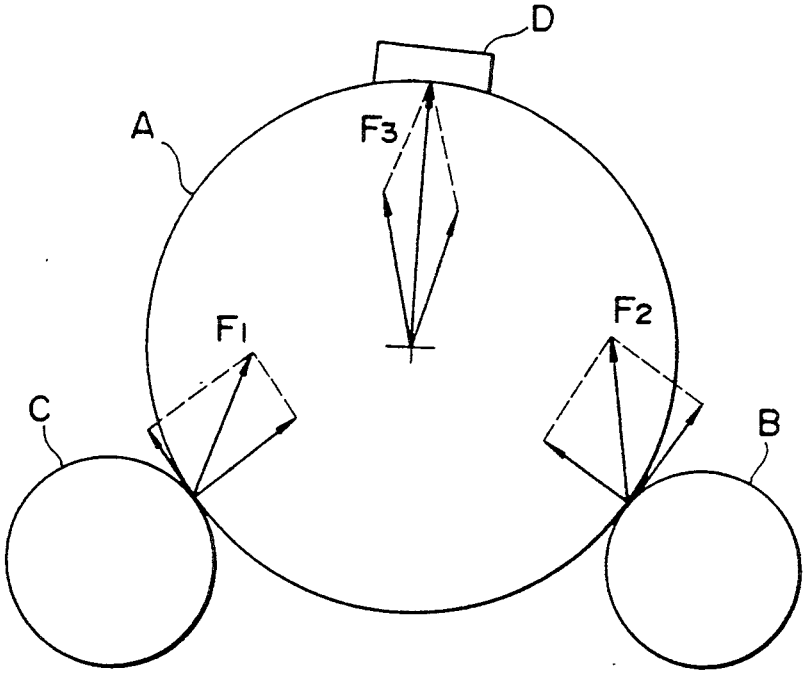
FIG. 3 is a diagram illustrating a principle of the present invention.

FIG. 3 is a diagram showing a principle of the present invention. In FIG. 3, members A, B, C, and D correspond to the photoconductive drum 11, the drive gear 30, one of the pair of gap adjustion rollers 22, and one of the contact members 40, respectively. In order to simplifying the explanation, the toothed portion is ommited, e.g., mesh between drive gear 30 and gear portion 11A in FIG. 1 is simplified in FIG. 3 such that a member B contacts member A.

At the beginning of the image forming operation, member A rotates as member B rotates. Accordingly, member C is rotated by member A. The forces indicated with arrow $F_1$ and $F_2$ in FIG. 3 are then generated at the respective contact portions of member A with members C and B. Then a resultant force $F_3$ obtained from the forces $F_1$ and $F_2$ urges member A to move in the direction of the resultant force $F_3$. However, since member D is arranged at the position confronting the resultant force $F_3$, movement of member A is prevented.

In the above example of FIG. 3, the circumferential positions of members B, C, and D substantially equally the circumference into three portions. However, if member C does not exist, another contact member similar to D can be employed at the position of member C. Further, the contact member D is arranged at one circumferential position of member A, a plurality of members D's can be arranged at a plurality of circumferental positions of member A.

As it can be understood by applying the above description into FIG. 1, the movement of the photoconductive drum 11 by the resultant force of the forces generated at the portion where the drive gear 30 meshes with the gear 11A, and the portion where the pair of gap adjusting rollers 22, 22 contact the circumferential surface of the photoconductive drum 11 is prevented by the pair of contact members 40, 40.

Consequently, at the beginning of the rotation of the photoconductive drum 11, the formation of the image is not disturbed by the irregular rotation thereof. Further, since the contact members 40, 40 contact the same portions of the photoconductive drum 11 as the gap adjusting rollers 22, 22 contact, the stain on the portions of the photoconductive drum 11 are cleaned by the contact members 40, 40 and thus the gap between the photoconductive drum 11 and the developing roller 21 can be accurately maintained.

Note that the contact member 40, 40 are preferably located at the portions opposite to the portion where the resultant force $F_3$ of the forces $F_1$ and $F_2$ is applied when the photoconductive drum 11 is rotated by the drive gear 30 and thus the gap adjusting roller 22 is rotated by the photoconductive drum 11. In the above embodiments, the circumferential positions where the photoconductive drum 11 contacts the gap adjusting rollers 22, 22 and the circumferential position where the photoconductive drum 11 is meshed with the drive gear 30 are substantially symmetrically arranged with respect to the vertical plane including the rotary axis of the photoconductive drum 11. Accordingly, when the contact members 40, 40 are arranged in such a manner that the circumferential position where contact members 40, 40 contact the photoconductive drum 11, the circumferential position where the drive gear 30 meshes with the gear 11A, and the circumferential position where the gap adjusting rollers 22, 22 contact the photoconductive drum 11 substantially equally divide the circumference into three portions. Arranged as above, the contact members 40, 40 are located at the position to which the photoconductive drum 11 is urged to move due to the resultant force $F_3$.

Alternatively, each of the angles, with respect to the rotary axis of said photoconductive drum 11, between any two adjacent portions where the contact members 40, 40 press the circumferential surface of the photoconductive drum 11, the portion where the gap adjusting rollers 22, 22 contact the photoconductive drum 11, and the portion where the drive gear 30 meshes with the gear member may be arranged to be less than 180 degrees.

With the arrangement as described above, the movement of the rotary axis of the photoconductive drum caused when it starts rotating is prevented by the movement regulation means, whereby the formation of a defective image due to the photoconductive drum can be prevented.

The present disclosure relates to subject matter contained in Japanese Utility Model Application No. HEI 2-107806 (filed on Oct. 15, 1990), which is expressl incorporated herein by reference in its entirely.

What is claimed is:

1. An irregular rotation prevention structure for a photoconductive drum employed in an electrophotographic imaging apparatus, comprising regulation means for regulating the movement of said photoconductive drum, said regulation means being located at a position substantially confronting a resultant force produced when said photoconductive drum starts rotation and acting in a direction perpendicular to a rotating axis of said photoconductive drum.

2. The irregular rotation prevention structure according to claim 1, wherein said regulation means comprises a pair of press members urged to the circumferential surfaces of the axial side ends of said photoconductive drum which do not contribute to the formation of an image.

3. The irregular rotation prevention structure according to claim 1, wherein said imaging apparatus further comprises a driving roller unit for rotating said photoconductive drum, a toner supply roller for supplying toner onto a circumferential surface of said photoconductive drum, and a pair of gap adjusting rollers arranged coaxially with said toner supply roller, a circumferential surface of each of said pair of gap adjusting rollers being contacted with the circumferential surface of said photoconductive drum to keep a gap of a predetermined amount between the circumferential surfaces of said toner supply roller and said photoconductive roller;

wherein said resultant force is produced by a combination of forces generated at the positions where said driving roller unit and said pair of gap adjusting rollers interact, respectively, with said photoconductive drum.

4. The irregular rotation prevention structure according to claim 1, wherein said regulation means comprises a pair of elastic members arranged to contact longitudinal end portions of the circumferential surface of said photoconductive drum.

5. The irregular rotation prevention structure according to claim 3, wherein circumferential angles between any adjacent portions of the three portions where said regulating means, said driving means, and said pair of gap adjusting rollers interact with the photoconductive drum, respectively, are substantially equal.

6. The irregular rotation prevention structure according to claim 3, wherein said pair of gap adjusting rollers contact said photoconductive drum at the portions which do not contribute to the image formation, said regulation means comprises a pair of elastic members made of felt, and said elastic members contact said photoconductive drum at substantially the same axial portions as said gap adjusting rollers contact, whereby said portions where said gap adjusting rollers contact are cleaned and the amount of said gap is substantially kept at said predetermined amount.

7. The irregular rotation prevention structure according to claim 3, wherein said drive roller unit and said pair of gap adjusting rollers are arranged such that the portions at which said drive roller unit and said pair of gap adjusting rollers interact with said photoconductive drum are located oppositely with respect to a vertical plane including the rotary axis of said photoconductive drum, and below a horizontal plane including the rotary axis of said photoconductive drum.

8. An irregular rotation prevention structure for a photoconductive drum employed in an electrophotographic imaging apparatus, comprising:

a plurality of peripheral devices mechanically connected to and interacting with said photoconductive drum; and regulation means for regulating the movement of said photoconductive drum due to the interaction between said photoconductive drum and said peripheral elements.

* * * * *